US006389624B1

(12) United States Patent
Madole

(10) Patent No.: US 6,389,624 B1
(45) Date of Patent: May 21, 2002

(54) PORTABLE CHILD CHANGING APPARATUS

(75) Inventor: Brenda L. Madole, Irvine, CA (US)

(73) Assignee: Balanced Health, Inc., Santa Ana, CA (US)

( * ) Notice: Subject to any disclaimer, the term of this patent is extended or adjusted under 35 U.S.C. 154(b) by 0 days.

(21) Appl. No.: 09/596,475

(22) Filed: Jun. 19, 2000

(51) Int. Cl.[7] ..... A47D 13/00
(52) U.S. Cl. ..... 5/655; 5/947; 5/424
(58) Field of Search ..... 108/54.1, 63; 5/655, 5/424, 99.1, 947, 93.2, 95

(56) References Cited

U.S. PATENT DOCUMENTS 3,721,434 A * 3/1973 Spies ..... 5/424
4,123,809 A * 11/1978 Pugh ..... 5/947
4,712,258 A * 12/1987 Eves ..... 5/424
4,935,973 A * 6/1990 Behrman ..... 5/655
5,615,433 A 4/1997 Martin
6,125,487 A * 10/2000 Ive ..... 5/655

* cited by examiner

*Primary Examiner*—Michael F. Trettel
(74) *Attorney, Agent, or Firm*—Stout, Uxa, Buyan & Mullins, LLP; Donald E. Stout

(57) ABSTRACT

A lightweight, simple, foldable changing table is disclosed, which can be easily carried and utilized to provide a safe and clean platform on which a child can be laid, in any setting, including a floor, the ground, or the like. The portable changing table comprises a table member having first and second foldable portions, which may be unfolded to an extended position to provide a surface on which the child may be laid, and may be folded and secured in the folded configuration, for storage and transport. A convenient carrying strap is provided for carrying the table on one's shoulder or slung over the handle of a stroller, for example. Advantageously, the inventive portable changing table is foldable into a very compact configuration, and is relatively inexpensive to manufacture.

17 Claims, 1 Drawing Sheet

PORTABLE CHILD CHANGING APPARATUS

BACKGROUND OF THE INVENTION

This invention relates generally to child care products, and more particularly to a portable baby changing table which may be conveniently transported and stored when not in use.

When away from home, and accompanied by an infant or small child in diapers, a parent or other care giver typically carries a diaper bag with various child care products, such as extra diapers, an extra set of clothes, baby wipes, baby powder, and the like. It is frequently the case that the child will require care, such as a diaper change, during the trip, if it is of a duration of more than an hour or so. Diaper bags typically comprise fabric bags having enclosed spaces for stowing baby care products. Some diaper bags even include a rolled-up or folded pad for the child to lay on while his or her diaper is changed.

Unfortunately, while at home a fully outfitted changing table is frequently available in order to conveniently change the child's diaper, this is usually not the case "on the road". Sometimes, a relatively clean public restroom facility, with built-in wall mounted changing tables is available. Then, the changing pad provided in some diaper bags can be laid on the changing table, for the baby's protection, and the soiled diaper can be changed relatively easily. However, oftentimes a child's "timing" is inconvenient, to say the least, and either no facility is available, or the available facility is not clean. Then, there is no reasonable place to lay out the changing pad. To lay it on the floor or ground, particularly if the floor is dirty, is unsavory, and uncomfortable for the child even if clean (because of hardness, and possible uneven terrain, rocks, etc.). Alternatives often used include the seat of a vehicle or the floor of the trunk or rear cargo space of a vehicle. However, vehicle seats are usually not level, and the baby tends to roll toward the backrest of the seat. Furthermore, the same can be true of vehicle cargo spaces, and it is often the case that vehicle cargo spaces have no readily available floor space, entailing an involved unpacking and repacking process. Additionally, the lingering unpleasant odors resulting from such a process can be a problem in a closed vehicle.

U.S. Pat. No. 5,615,433 to Martin discloses a proposed solution to the problems discussed above. In this patent, a combination diaper bag and portable changing table is disclosed. The changing table comprises an enclosure having a pivotal lid, which can be opened to form the changing table. The lid is supportable on a pivotal leg, to maintain an even height with the enclosure portion, which includes a solid upper surface, so that the enclosure portion and lid together form the table surface on which the baby can be laid. A fan mechanism is provided within the enclosure, for the ostensible purpose of drawing odors away from the vicinity of the infant.

Unfortunately, Martin's proposed solution to the aforementioned problems is unduly complex, and impractical for the average parent. To manufacture such a device is relatively expensive, and it is bulky and heavy to carry. Furthermore, it is questionable, to say the least, as to whether the purported benefit is worth the expense and inconvenience attendant to this disclosed system.

What is needed, therefore, is a portable changing table which is easy and convenient to use, lightweight, simple, and very compact, so that it may be conveniently transported and stored, but which also provides a stand-alone, clean platform on which a child may be laid, in any location, in order to readily change the child's diaper and effect any necessary clean-up

SUMMARY OF THE INVENTION

The present invention solves the aforementioned problems by providing a lightweight, simple, foldable changing table, which can be easily carried and utilized to provide a safe and clean platform on which a child can be laid, in any setting, including a floor, the ground, or the like. The portable changing table comprises a table member having first and second foldable portions, which may be unfolded to an extended position to provide a surface on which the child may be laid, and may be folded and secured in the folded configuration, for storage and transport. A convenient carrying strap is provided for carrying the table on one's shoulder or slung over the handle of a stroller, for example. Advantageously, the inventive portable changing table is foldable into a very compact configuration, and is relatively inexpensive to manufacture.

More particularly, there is provided a portable child changing apparatus, which comprises a table member, comprised of a first foldable portion and a second foldable portion. The first and second foldable portions each have a thickness and are together hinged to be configurable into both a compact folded orientation, with the first foldable portion being stacked atop the second foldable portion, and an extended usable orientation, with the first foldable portion and the second foldable portion together forming a single planar surface on which a child may be laid. Each of the first and second foldable portions are preferably molded of a rigid plastic. Importantly, in order to provide a very compact arrangement, the thickness of each of the first and second foldable portions is substantially the same, such that a combined thickness of the first and second foldable portions when they are stacked in the aforementioned compact folded orientation is approximately double the thickness of each of the first and second foldable portions individually.

Another important feature of the invention is that the single planar surface formed by the unfolded first and second foldable portions has no substantial openings therein. This solid, smooth surface on which a child may be laid is advantageous in that it prevents any incidental injuries or discomfort to a squirming child. This is not the case in the Martin '433 patent, which incorporates a large opening in the center portion of the table for receiving airflow.

Yet another important feature of the present invention is the provision of a plurality of legs for supporting the table member when the table member is in the extended usable orientation. The plurality of legs, preferably four (two on each foldable portion), are pivotable between a retracted position and a deployed position. When it is desired to set up the portable changing apparatus for use, the legs may be deployed to provide a convenient and clean elevated platform for the baby to be changed. Alternatively, they may remain retracted, with the table resting directly on the ground, floor, or other supporting surface. Importantly, when the plurality of legs are deployed, there is a space having a predetermined height approximately equal to a height of each of the plurality of legs beneath both foldable portions of the table member, and, when the plurality of legs are retracted, but the foldable portions of the table member are in the extended usable orientation, both of the first and second foldable portions are lying substantially flat on a supporting surface.

In another aspect of the invention, a method of changing a child's diaper is disclosed. The method comprises a first step of removing a portable child changing apparatus, comprising first and second foldable portions, from a position wherein the portable child changing apparatus is suspended from a supporting structure, such as a person's shoulder, via a carrying strap. Then, the portable child changing apparatus is opened by unfolding one of the first and second foldable portions relative to the other one, so that the first and second foldable portions form a single planar surface upon which a child can be laid. The child is then secured on the single planar surface, and his or her diaper is changed, or other needs attended to. Once the desired procedure is completed, the portable child changing apparatus is closed by folding one of the first and second foldable portions relative to the other one, so that a total thickness of the first and second foldable portions together is about twice the thickness of either one of the first and second foldable portions alone. Then, the folded first and second foldable portions may be secured together by means of a closure strap or the like, and the apparatus may be re-suspended from the same or a different supporting structure.

The invention, together with additional features and advantages thereof, may best be understood by reference to the following description taken in conjunction with the accompanying illustrative drawing.

DESCRIPTION OF THE PREFERRED EMBODIMENT

Figure 1:
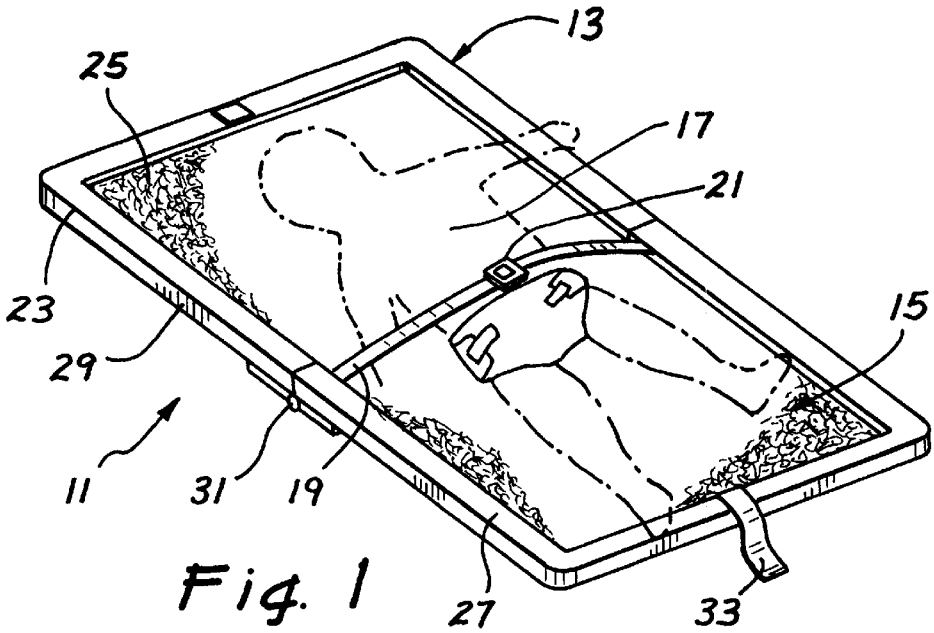
FIG. 1 is a perspective view of a preferred embodiment of the inventive portable changing apparatus, illustrating a child secured thereon.
Figure 2:
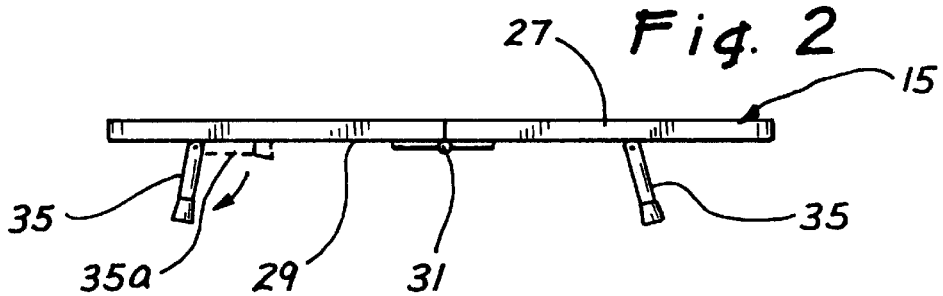
FIG. 2 is a side plan view of the portable changing apparatus illustrated in FIG. 1.
Figure 3:
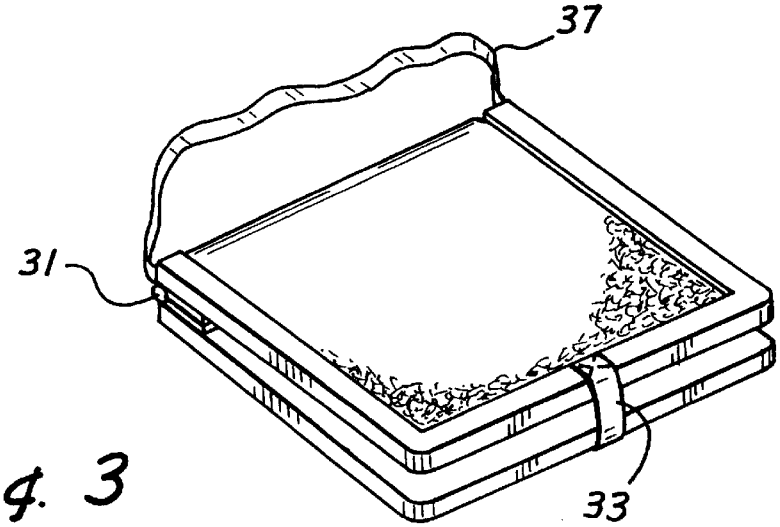
FIG. 3 is a perspective view similar to FIG. 1, illustrating the inventive portable changing apparatus in a folded configuration.

Referring now more particularly to FIGS. 1–3, there is shown a portable child changing apparatus 11 which is constructed in accordance with the principles of the present invention. The apparatus 11 comprises a table member 13 having an upper receiving surface 15, on which a child 17 may be laid, and a retaining strap 19, of known construction, for securing the child 17 on the upper receiving surface 15. The retaining strap 19 includes a buckle 21 for securing the strap about the child. The buckle 21 may utilize a known male-female snap connector mechanism, or may utilize any other known fastening mechanism, including hook and loop (e.g. VELCRO®) fasteners or the like. The table member 13 is preferably molded of a rigid plastic material, with a raised retaining edge 23 extending peripherally about the upper receiving surface 15. A foldable foam cushion or pad 25, for the child's comfort, may be disposed on the upper receiving surface, in such a manner that it is removable from the surface 15. Alternatively, the pad 25 may be fixedly secured to the surface 15, by use of adhesive or the like.

A particularly advantageous feature of the invention is the construction of the table member 13 to comprise first and second foldable planar portions 27, 29, respectively, which are pivotally secured together by means of hinges 31. Preferably, a pair of hinges 31 (only one is shown) are utilized, one on each side of the table member 15. The use of such a hinged, foldable design enables the apparatus 11 to be conveniently folded into a compact configuration, as shown in FIG. 3, for the purpose of easy transport and storage. Unlike the prior art design shown in the Martin '433 patent, the inventive table is of a solid, simple, and compact construction, with no access openings in the upper receiving surface, which can cause injury to an infant lying thereon, and no bulky box structure below either of the first or second foldable portions 27 or 29. A strap closure 33 (FIGS. 1 and 3) may be employed for securing the apparatus 11 in its folded configuration, as shown in FIG. 3.

As shown in FIG. 2, the inventive apparatus 11 preferably employs a plurality of folding legs 35 (two are shown, but four are preferred, two on each side and at each end of the table 15). The legs 35 are hinged as shown in FIG. 2, so that they are pivotable between a deployed position, as shown in solid line, and a retracted position, as shown in phantom lines 35*a*. In practice, the legs 35 are folded into their retracted position when it is desired to fold the apparatus 11 into the compact configuration shown in FIG. 3. When the apparatus 11 is in its usable configuration, as shown in FIG. 1, the legs may either be deployed, in order to level out the table, elevate the child 17 for easier access by the care giver attending to the child's needs, and/or to avoid dirty conditions which may be present on the floor or other supporting surface, or the legs 35 may be retained in their retracted position. When the legs are retracted, the entire table, including both foldable portions 27, 29, lies directly on the supporting surface. When the legs are deployed, a space having a height approximately equal to that of each leg, is disposed under each of the foldable portions.

When it is desired to store or transport the apparatus 11, as described supra, the apparatus is reduced to its folded configuration (FIG. 3). Then, it may be stored in a closet, box, bag, or any other desired storage location. When being transported from place to place by the care giver, a carrying strap 37 is preferably provided. The strap 37 provides the care giver with the option to sling the apparatus 11 over the shoulder or onto the handle of a stroller, for example, for convenient transportation thereof.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A portable child changing apparatus, comprising:

a table member, comprised of a first foldable portion and a second foldable portion, the first and second foldable portions each having a thickness and together being configurable into both a compact folded orientation, with the first foldable portion being stacked atop the second foldable portion, and an extended usable orientation, with the first foldable portion and the second foldable portion together forming a single planar surface on which a child may be laid;

the thickness of each of said first and second foldable portions being substantially the same, such that a combined thickness of said first and second foldable portions when they are stacked in said compact folded orientation is approximately double the thickness of each of said first and second foldable portions individually and;

a plurality of legs for supporting said table member when said table member is in said extended usable orientation, said plurality of legs being pivotable between a retracted position and a deployed position.

2. The portable child changing apparatus as recited in claim 1, wherein said single planar surface has no substantial openings therein.

3. The portable child changing apparatus as recited in claim 1, and further comprising a hinge for pivotally joining said first and second foldable portions.

4. The portable child changing apparatus as recited in claim 3, and further comprising a closure means for securing said first and second foldable portions together in said compact folded orientation.

5. The portable child changing apparatus as recited in claim 1, and further comprising a strap for securing a child on said single planar surface.

6. The portable child changing apparatus as recited in claim 1, wherein when said plurality of legs are deployed, there is a space having a predetermined height approximately equal to a height of said plurality of legs beneath both foldable portions of said table member, and, when said plurality of legs are retracted, but said foldable portions of said table member are in said extended usable orientation, both of said first and second foldable portions are lying substantially flat on a supporting surface.

7. The portable child changing apparatus as recited in claim 1, wherein said each of said first and second foldable portions are constructed of a rigid material.

8. The portable child changing apparatus as recited in claim 7, wherein said rigid material comprises molded plastic.

9. The portable child changing apparatus as recited in claim 1, and further comprising a shoulder strap attached to said apparatus for permitting said apparatus to be slung over one's shoulder for convenient transport.

10. A method of changing a child's diaper, comprising:

removing a portable child changing apparatus, comprising first and second foldable portions, from a position wherein said portable child changing apparatus is suspended from a supporting structure via a carrying strap;

opening said portable child changing apparatus by unfolding one of said first and second foldable portions relative to the other one, so that said first and second foldable portions form a single planar surface upon which a child can be laid;

deploying pivotable legs for supporting each of said first and second foldable portions, wherein at least one of said legs is pivotally attached to each of said first and second foldable portions, and when legs are deployed, each of said first and second foldable portions is elevated above a supporting surface, so that there is a space having a height approximately equal to that of each of the legs beneath each of said first and second foldable portions;

securing a child on said single planar surface;

changing said child's diaper;

closing said portable child changing apparatus by folding one of said first and second foldable portions relative to the other one, so that a total thickness of said first and second foldable portions together is about twice the thickness of either one of said first and second foldable portions alone; and securing said folded first and second foldable portions together.

11. The method as recited in claim 10, and further comprising a step of re-suspending said portable child changing apparatus, using said carrying strap, from said supporting structure.

12. The method as recited in claim 10, wherein said supporting structure comprises a user's shoulder.

13. The method as recited in claim 10, wherein said supporting structure comprises a stroller handle.

14. The method as recited in claim 10, wherein a strap is used to secure said child to said single planar surface.

15. The method as recited in claim 10, and comprising a further step of retracting each of said plurality of pivotal legs after changing said child's diaper.

16. A portable child changing apparatus, comprising:

a table member, comprised of a first foldable portion and a second foldable portion, the first and second foldable portions each having a thickness and together being configurable into both a compact folded orientation, with the first foldable portion being stacked atop the second foldable portion, and an extended usable orientation, with the first foldable portion and the second foldable portion together forming a single planar surface on which a child may be laid;

the thickness of each of said first and second foldable portions being substantially the same, such that a combined thickness of said first and second foldable portions when they are stacked in said compact folded orientation is approximately double the thickness of each of said first and second foldable portions individually;

a raised retaining edge disposed about a periphery of said single planar surface; and a strap for securing a child on said single planar surface, said strap extending across said surface from said raised retaining edge;

wherein said single planar surface comprises a solid, smooth surface, having no substantial openings therein.

17. A portable child changing apparatus, comprising:

a table member, comprised of a first foldable portion and a second foldable portion, the first and second foldable portions each having a thickness and together being configurable into both a compact folded orientation, with the first foldable portion being stacked atop the second foldable portion, and an extended usable orientation, with the first foldable portion and the second foldable portion together forming a single planar surface on which a child may be laid;

the thickness of each of said first and second foldable portions being substantially the same, such that a combined thickness of said first and second foldable portions when they are stacked in said compact folded orientation is approximately double the thickness of each of said first and second foldable portions individually;

a raised retaining edge disposed about substantially an entire periphery of said single planar surface; and a strap for securing a child on said single planar surface, said strap extending across said surface from said raised retaining edge.

* * * * *